United States Patent [19]

Phillips

[11] 4,088,314

[45] May 9, 1978

[54] SYNCHRONOUS STACKING DEVICE

[75] Inventor: Ronald Alfred Phillips, Pittsford, N.Y.

[73] Assignee: Eastman Kodak Company, Rochester, N.Y.

[21] Appl. No.: 789,904

[22] Filed: Apr. 22, 1977

[51] Int. Cl.[2] ..... B65H 43/00

[52] U.S. Cl. ..... 271/176; 271/80; 271/178; 271/187

[58] Field of Search ..... 271/80, 173, 174, 176, 271/199, 178, 187

[56] References Cited

U.S. PATENT DOCUMENTS

| | | | |
|---|---|---|---|
| 3,847,384 | 11/1974 | Bethke | 271/187 X |
| 3,912,255 | 10/1975 | McInerny | 271/178 X |

*Primary Examiner*—Richard A. Schacher
*Attorney, Agent, or Firm*—D. R. Arndt

[57] ABSTRACT

A synchronous stacking device for receiving and stacking documents fed to it in a random spaced apart relationship by a delivery mechanism. Documents move from the delivery mechanism through a movable guide track having first and second positions, toward a rotating carrier for insertion into one of a plurality of equally spaced document-accepting pockets which are interspersed with document non-accepting segments. The carrier delivers the inserted documents to a stripping station when the previously inserted documents are removed and deposited on a stacking platform. Comparator means are provided for sensing the orientation of the carrier relative to a document in the delivery mechanism and moving the guide means to the second position whenever the orientation of the carrier would result in the document encountering a non-accepting segment of the carrier and would not allow the document to enter a document-accepting pocket if the guide means were to remain in the first position.

6 Claims, 12 Drawing Figures

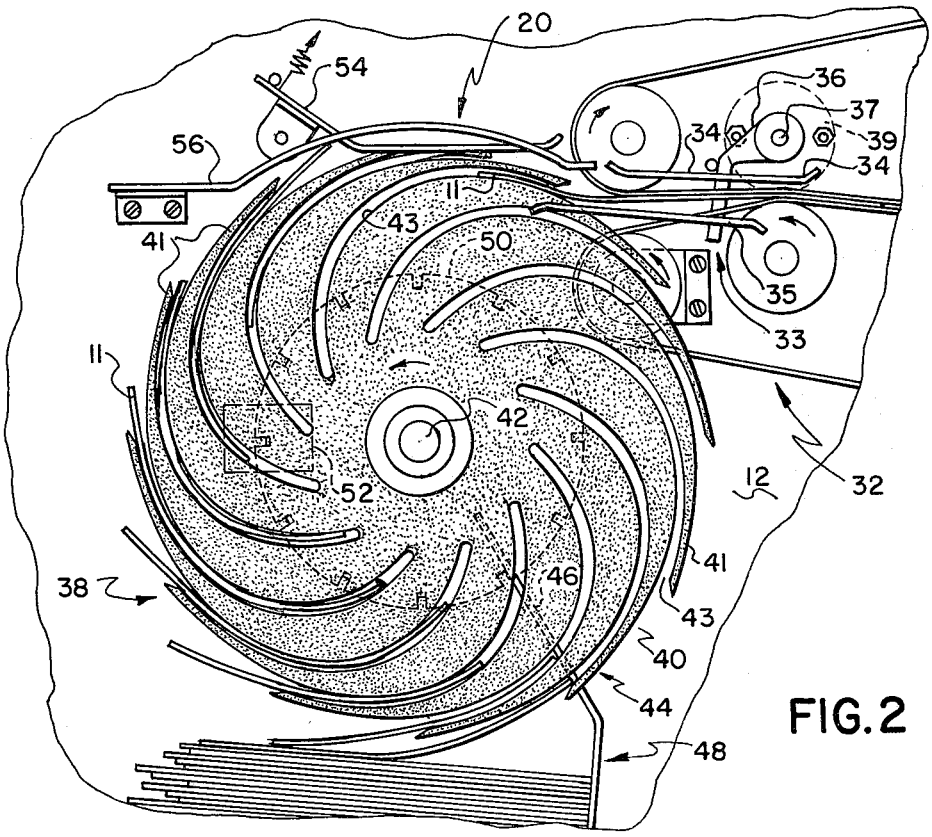
FIG.2
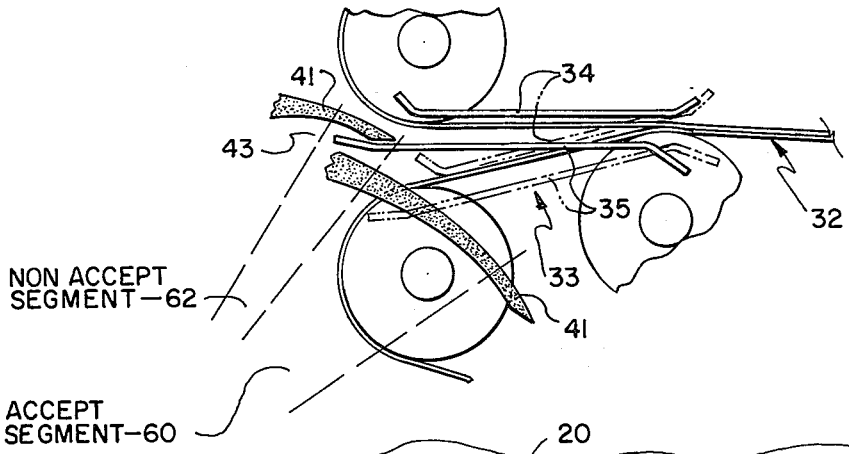
FIG.3
FIG.4
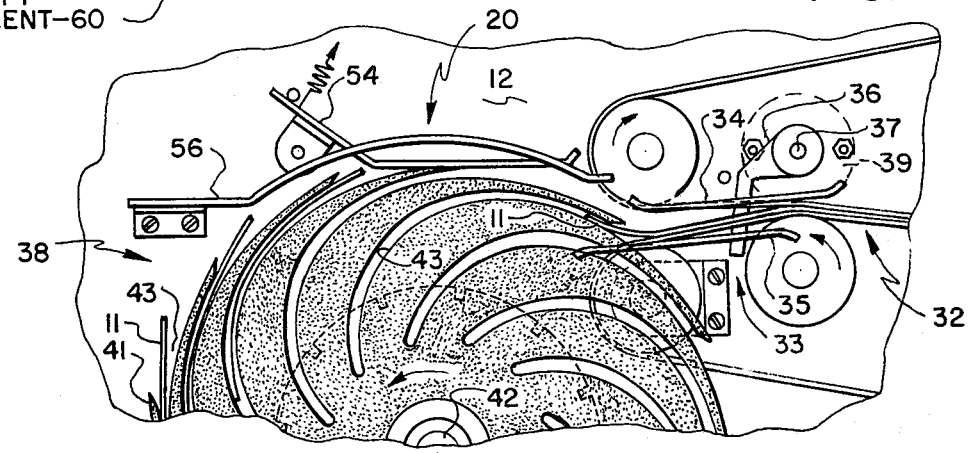

SYNCHRONOUS STACKING DEVICE

BACKGROUND OF THE INVENTION

1. Field of the Invention

The present invention relates to devices for the stacking a random sized documents delivered at high speeds in a spaced apart relationship. Upon completion of the stacking operation, two adjacent edges of the randomly sized documents are stacked in register.

2. Description of the Prior Art

Stacking devices of the rotating delivery fan or spiral carrier type are well known. Such devices use a rotating member, such as, a drum or a plurality of discs mounted for rotation on a common axis. The rotating member contains a plurality of arcuateshaped, evenly spaced receiving slots designed to receive an item fed at a relatively high rate and to substantially decelerate the item. Sections or walls of the rotating member, which are shaped to a thin edge to present a minimum edge profile, separate adjacent slots. An item is fed by any suitable delivery or feeding mechanism, such as a system of feed belts and rollers, into one of the receiving slots. When the rotating member is formed from a plurality of discs, a deflector may extend from the feed mechanism into the space between adjacent discs to ensure proper insertion of an item into a slot. It is also known to at least partially enclose the rotating member with a fixed arcuate-shaped member to aid in the retention of items within the rotating member. After an item has been inserted into a slot, the rotating member advances the item to a stripping station where a stripping member, positioned in the space between adjacent discs, engages the leading edge of the item, removes the item from the rotating member, and transfers the item to a conveyor belt or stacking table. Descriptions of stacking devices of the previously described type are found in U.S. Pat. No. 1,956,541, entitled "Delivery Mechanism for Printing Machines"; U.S. Pat. No. 3,162,439, entitled "Document Stacking Devices"; and U.S. Pat. No. 3,847,384, entitled "Apparatus for Collating Sheet-Like Elements".

It is known, in stacking devices of the aforementioned type, to use deflecting means between the delivery mechanism and the rotating member. For instance, U.S. Pat. No. 2,403,062, entitled "Delivery Mechanism for Printing Machines", teaches the use of a solenoid-actuated lever or "kicker" rotatably mounted adjacent the rotating member. The lever is actuated to prevent spoiled copies from reaching the rotating member. In U.S. Pat. No. 3,313,538, entitled "Automatic Guide-Out for Printed Papers from a Rolling Press," arcuate-shaped guide-out boards are provided between the delivery mechanism and the rotating member to divert a document or sheet to an inspection station. In U.S. Pat. No. 3,851,872, entitled "Sorting Apparatus for Collating Simplex and Duplex Copies", a deflector gate member is provided to deflect copy sheets down one of two paths leading to a rotating member. Copy sheets following the first path will be inserted into the rotating member face-up. Copy sheets following the second path will be inserted into a different area of the rotating member face-down.

When stacking devices of the aforementioned type are used, the leading edge of each item must be in phase with the rotation of the rotating member so that successive items will properly enter the receiving slots in the member. Maintaining this necessary synchronization between the speed of rotation of the rotating member and the rate of delivery of items can become extremely difficult. This is particularly true when either different batch sizes or intermixed size items are handled. Synchronization becomes even more difficult when the feeding of items is random and/or intermittent. One solution to the problem of synchronization is described in U.S. Pat. No. 3,531,108, entitled "Document Stacker and/or Sorter", which discloses the use of a stacking device having a sensor for sensing the position of the slots in the rotating member and a sensor for sensing the position of the item in the delivery mechanism. Depending upon the relationship between the position of the item and the receiving slot, the item is either accelerated or decelerated over a short distance within the document handling system to bring it into phase or synchronization with the slot in the rotating member. Another solution to the synchronization problem involves the use of a deflector member to direct a document to alternate paths having different discrete lengths. These known solutions require the use of complex, expensive equipment to precisely control the rate of rotation of the rotating member, the rate of delivery of items to the rotating member, and/or the spacing between items fed to the rotating member.

SUMMARY OF THE INVENTION

The present invention provides an improved stacking device for the synchronous stacking of documents without varying either the rate of document feed or the rate of rotation of the rotating carrier within the stacking device.

Documents of varying size are fed from a delivery mechanism to the stacking device in a random, intermittent, spaced-apart relationship. In accordance with the invention, the documents move from the delivery mechanism through a movable guide track or deflector to a rotating carrier where they pass into one of a plurality of receiving slots in the rotating carrier. The carrier, which comprises a plurality of spaced-apart, slotted discs mounted for synchronous rotation to a common shaft, delivers the documents to a stripping station where a stripping member is positioned between adjacent discs and contacts the leading edge of each document, forcing it from its slot and depositing it on a stacking platform. The stacking platform is preferably skewed in such a manner that items placed on the platform will form a stack with two adjacent edges in alignment. Fixed and resilient mounted guides are positioned around a portion of the path of rotation of the carrier to assist the insertion of items into the receiving slots and to retain inserted items in the carrier.

A control circuit is provided which compares a first signal developed by sensing the leading edge of a document passing a specified point in the delivery mechanism and a second signal developed by sensing the angular position of the carrier. The circuit generates an output signal when it senses that a document moving through the guide track in the first or normal position thereof will not be properly aligned with a receiving slot. The output signal actuates a rotary solenoid which moves the guide track to its second or deflecting position causing the document to be deflected downwardly to a different area or segment of the carrier where a receiving slot is available. The solenoid is held energized a predetermined time after actuation, thereby insuring sufficient time for the document to properly pass into the slot. At the expiration of this time, the guide track is returned by a spring to its position.

Since synchronization of the document feeding with the stacking device is obtained through the use of the solenoid-actuated guide track, the present invention enables synchronous stacking without varying either the rate of document feed or the rate at which the carrier is rotated. Also, the stacking device of the present invention is able to handle items having different widths, lengths, thicknesses, surface finishes, and surface textures.

The invention and its features and advantages will be set forth and become more apparent in the detailed description of the preferred embodiments presented below.

BRIEF DESCRIPTION OF THE DRAWINGS

In the detailed description of the preferred embodiments of the invention presented below, reference is made to the accompanying drawings, in which:

FIG. 2 is an enlarged view of a portion of the apparatus of FIG. 1 illustrating a movable guide track of the stacking device in its first or normal position;

FIG. 3 diagrammatically illustrates areas on the carrier where advancing documents may be accepted by the carrier or will not be accepted and require deflection;

FIG. 4 is an enlarged view similar to FIG. 2 illustrating the movable guide track in its extended or deflecting position;

FIGS. 8*a*–8*e* are timing diagrams illustrating the signals produced by the circuit of FIG. 7.

DESCRIPTION OF THE PREFERRED EMBODIMENTS

Because stacking devices are well known, the present description will be directed in particular to elements forming part of, or cooperating more directly with, apparatus in accordance with the present invention. It is to be understood that elements not specifically shown or described may take various forms well known to those skilled in the art.

Figure 1:
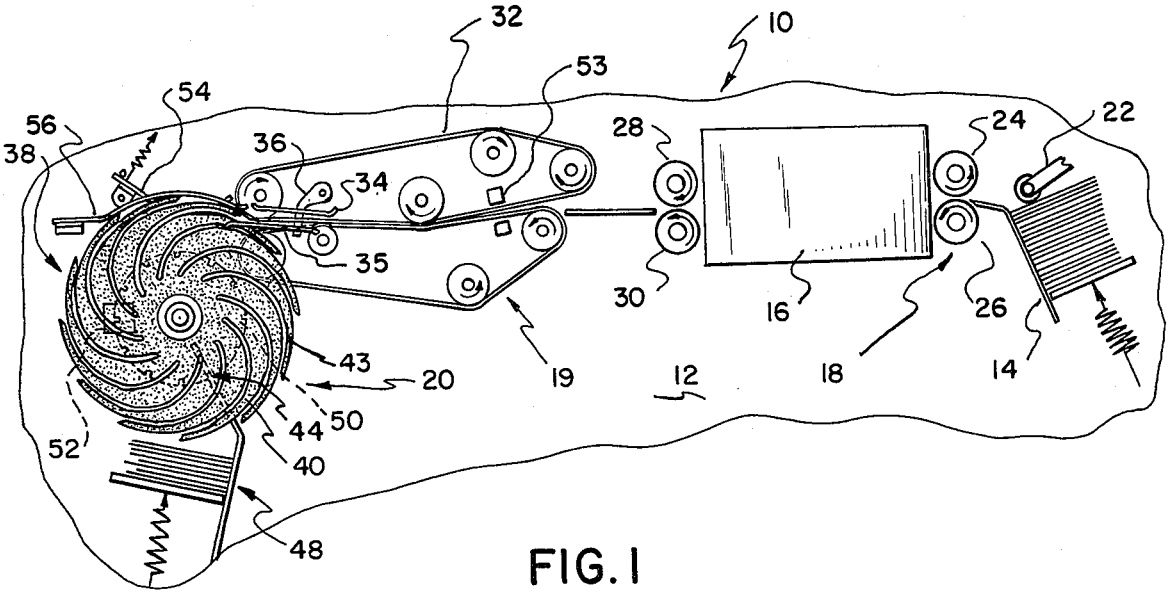
FIG. 1 is a side view of an apparatus utilizing the improved stacking device of the present invention.

Although the stacking device of the present invention is illustrated as part of a combination check endorser and microfilming apparatus, it should be understood that use of the improved stacking device of the present invention is not limited to such apparatus. Referring now to FIG. 1, the components of the combination check cancellation and microfilming apparatus, generally designated 10, are illustrated. The apparatus 10 is comprised of a housing, a portion of which designated 12 is shown, a spring-biased receiving tray 14, a filming and endorsing station 16 for imprinting and microfilming checks, a feed mechanism, generally designated 18, a delivery mechanism 19, and the stacking device of the present invention, generally designated 20.

The feed mechanism 18 is comprised of drive rollers 22, 24, and 26. Checks or documents 11 are loaded into a spring loaded receiving tray 14 which urges the top document against drive roller 22 mounted on housing 12 in such manner that upon rotation of the roller 22 in a clockwise direction, it frictionally advances the document into the nip of drive rollers 24, 26. Drive rollers 24, 26 are both driven in the same counterclockwise direction, as shown by arrows A in FIG. 1; however, drive roller 26 rotates at a faster rate than drive roller 24. When a check is advanced into the nip of drive rollers 24, 26 by drive roller 22, the faster rate of rotation of drive roller 26 will ensure insertion of the check into station 16; however, if two checks are fed simultaneously into the nip of drive rollers 24, 26, the rotation of drive roller 24 prevents the uppermost check from entering station 16. After filming and endorsing within station 16, the document is fed into delivery mechanism 19 via rollers 28, 30 and into the belt transport section 32 which accelerates the rate of movement of the document. For example, documents may be fed from drive rollers 28, 30 at the rate of 180 inches/second into the belt transport section 32 for acceleration to a rate of 300 inches/second. By accelerating the documents through the belt transport section 32, it is insured that the documents are delivered in an individualized, spaced-apart relationship to the stacking device 20 for proper stacking.

FIG. 2 illustrates in more detail the components of the stacking device 20. As the document emerges from belt transport section 32, it is inserted into a guide track 33 which comprises four pairs of upper and lower formed wires 34 and 35 respectively. The formed wire pairs 34, 35 are attached to a common supporting member 36 which in turn is mounted on a spring biased, rotatable shaft 37 which may be rotated a fixed amount in a counterclockwise direction from its FIG. 2 position by energization of rotary solenoid 39 rigidly attached to the housing 12.

For purposes of illustration and in accordance with the preferred embodiment, the guide track 33 has been shown as formed wire pairs separate and distinct from the belt transport section 32. However, it is contemplated that the guide track could be made integral with the transport system, even though not preferred because of the increased mass, so that the discharge portion of the belt transport could be rotated a fixed amount to vary the point of discharge.

Figure 5:
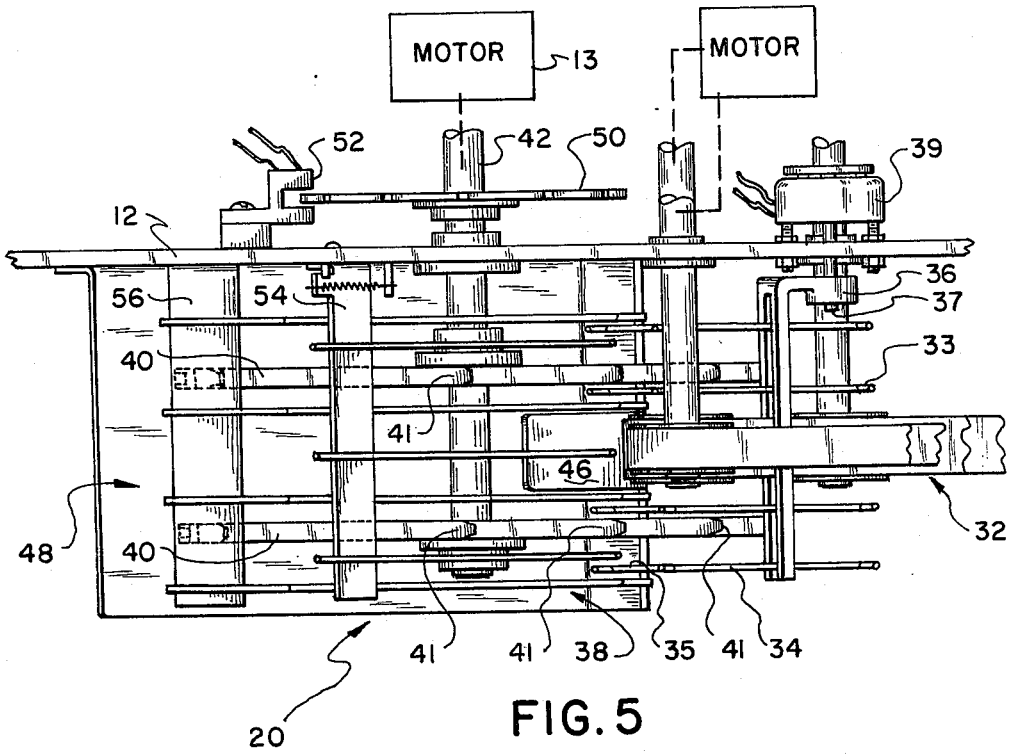
FIG. 5 is a top view of the stacking device of FIG. 2.

Turning to FIG. 5, it can be seen that the guide track 33 extends beyond the belt transport 32 and into the stacking device 20. The stacking device includes a carrier 38 which comprises a pair of identical slotted discs 40 which are fixedly mounted on a common shaft 42 in a spaced apart relationship with the slots 43 (FIGS. 2 and 4) of each disc being aligned with the slots 43 of the other disc so that upon rotation of the shaft by a motor 13 or other suitable means, the discs 40 will rotate with their slots 43 in synchronism. It should be understood that even though a circular carrier is shown for purposes of illustration, the carrier could take many forms such as an endless conveyor.

The slots 43 in the disc 40 are of a constant width and start near the central portion of the disc and extend outwardly in a spiral fashion and open generally tangentially through the periphery of the disc 40. The slots 43 are separated from one another by tapered finger members 41 which decrease in width as they extend from the central portion of the disc 40 arcuately toward the periphery where they terminate in a point which is generally tangential to the periphery of the disc 40.

Thus, as a document exits the guide track 33, it is inserted into aligned slots 43 of the discs 40 of the carrier 38, which causes the document to decelerate as it moves deeper into the slot 43 as a result of the spiral shape of the slot 43. To insure proper insertion of the document 11 into the carrier 38, spring biased guide members 54 are provided. In addition, fixed guide members 56 positioned around at least a portion of the periphery of the carrier assist in the retention of documents 11 inserted in the receiving slots 43 of the carrier 38.

Once properly inserted in the carrier the document is conveyed by the carrier 38 to a stripping station 44 which comprises an angularly shaped stripping member 46, which extends into the space between the adjacent discs 40 of the carrier 38. As the carrier 38 rotates, the leading edge of the document 11 positioned in the slot 43 engages the stripping member 46, thereby forcing the document out of the aligned slots 43 of the carrier 38, depositing the document 11 on a skewed spring-biased stacking platform 48. As subsequent documents are stripped from the carrier 38, the skewed stacking platform 48 will cause the documents to be stacked with two adjacent edges of all the documents in alignment.

The majority of the documents 11 delivered to the stacking device 20 are handled as described above. However, as shown in FIG. 3, a problem may be encountered when an arriving document 11 reaches the carrier 38 and a receiving slot 43 is not in proper position to receive the document, thus resulting in a collision between the document 11 and one of the tapered fingers 41. Each disc 40 has twelve finger slot pairs and associated with each is an accept segment 60 and a non-accept segment 62 (FIG. 3). If a document delivered to the carrier 38 for insertion reaches the carrier 38 in a non-accept segment 62, it will collide with one of the fingers 41 rather than move into an opening of a receiving slot 43, thus resulting in a jam and/or damage of the document.

To overcome this problem, guide track 33 which can assume one of two positions is used to insure that documents are at all times directed to an accept segment of the carrier. A first or normal position is shown in FIG. 2 and a second or deflecting position is shown in FIG. 4, which it assumes upon the energization of rotary solenoid 39. When the solenoid 39 is not energized, a spring (not shown) returns the guide track to the first or normal position. With the guide track 33 in the first or normal position, the document moves in substantially a straight path from the belt transport 32 to the carrier 38. When the guide track 33 is in the second position, it deflects the document downwardly to a different area or segment of the carrier 38 where an accept segment 60 is available to receive the document; thus selective movement of the guide track 33 to one of the positions shown, will insure that delivered documents will be guided to an accept segment 60 of the carrier 38 for proper insertion.

To determine the proper position of the guide track 33 for each advancing document 11, it is necessary that the angular position of the carrier 38 be compared to the position of the document 11 being delivered by the belt transport section 32. To accomplish this, a photoelectric sensor 52 in conjunction with a segmented disc 50 mounted for rotation on shaft 42 generates a signal representative of the instantaneous angular position of the tapered fingers 41 on the disc 40 which separate and define the receiving slots 43. A second photoelectric sensor 53 shown in FIG. 1 is provided to generate a signal when the leading edge of a document passes a given point in the belt transport section 32.

Figure 6:
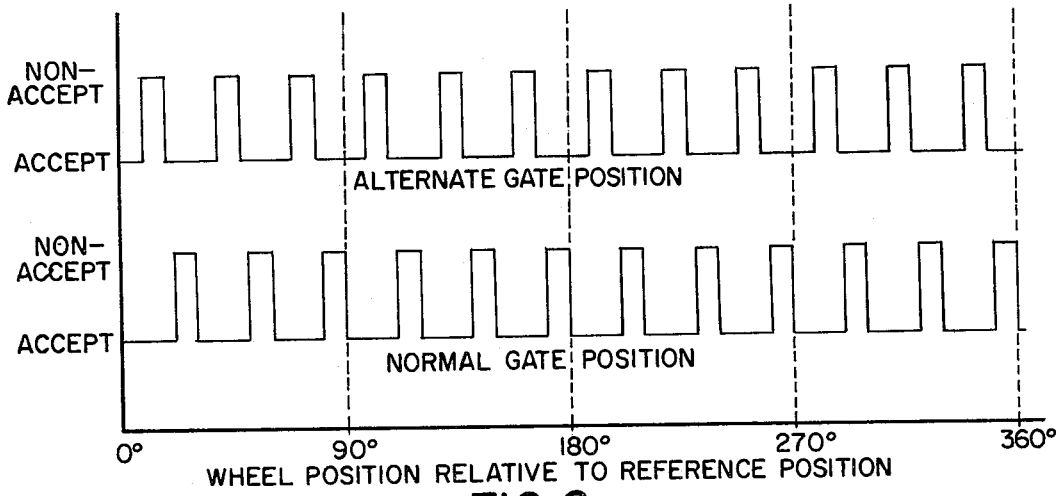
FIG. 6 is a timing diagram illustrating the relationships between the normal and second guide track positions and a rotating carrier used in the stacking device of FIG. 1.

FIG. 6 graphically depicts the overlapping relationship between accept and non-accept segments of the carrier with the guide track 33 in its first or normal position and in the second or deflecting position. For the purpose of the graph, the reference position zero degrees has been defined as that position of carrier 38 where a document following guide track 33 in its first or normal position will be able to enter a receiving slot 43 without colliding with one of the fingers 41 of the disc 40. After carrier 38 rotates a distance approximately proportional to the size of the opening of a receiving slot 43 past the zero degree reference position, a finger 41 of the disc 40 will be in a position to block the insertion into carrier 38 of a document following guide track 33 in its first position. However, as shown in FIG. 5 a document following guide track 33 in its second or deflecting position will enter carrier 38 properly. Thus, it can be seen that a document will always be able to enter carrier 38 as long as guide track 33 is properly positioned. There is no need to precisely control or vary either the rate of rotation of the carrier 38 or the rate of advance of the documents into the individual receiving slots 43. This allows the use of a random feed type friction feeder without controlling either the size or timing of the feed of the documents being delivered to the stacking device 20.

Figure 7:
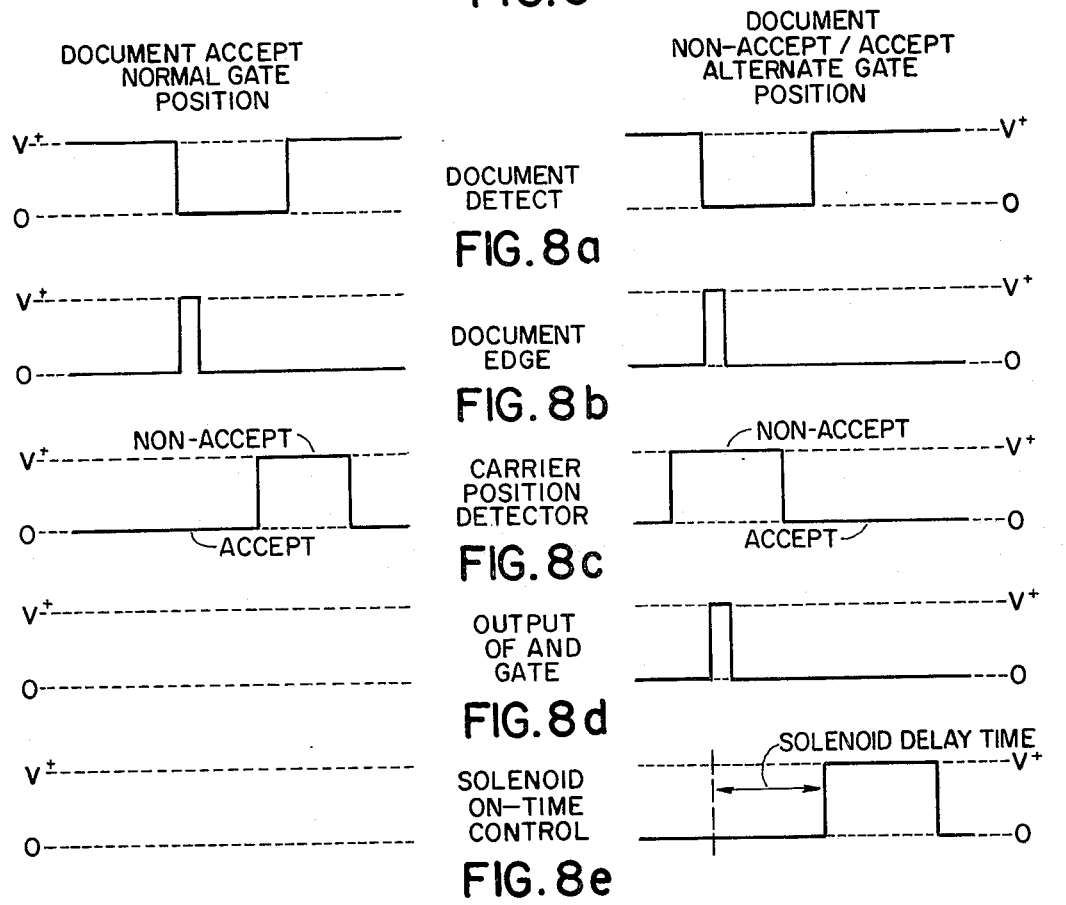
FIG. 7 is a block diagram of one embodiment of a circuit utilized to control the movement of the guide track of the stacking device of FIG. 1.
Figure 7:
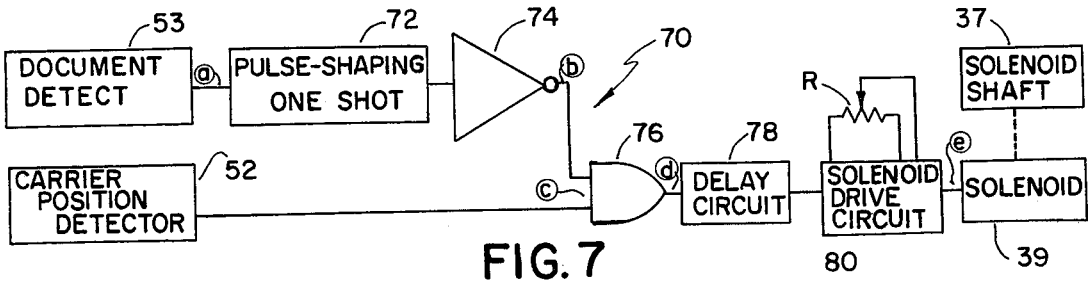

FIG. 7 illustrates a circuit in block form, generally designated 70, for controlling the movement of guide track 33. The circled letters adjacent some of the components of FIG. 7 refer to the wave forms shown in FIG. 8. The circuit 70 in a manner to be hereinafter described, is designed to initiate movement of guide track 33 to its second position by energizing solenoid 39 whenever the circuit determines that a document 11 following the guide track 33 in its first position would collide with fingers 41 of disc 40 instead of encountering a receiving slot 43.

As a document advances through the belt transport section 32 its presence is sensed by sensor 53 and a logic low signal, as shown in FIG. 8*a*, is generated. The signal is shaped by a conventional pulse shaping circuit 72, such as one shot multivibrator and inverted by inverter 74 to provide, as shown in FIG. 8*b*, a logic high signal representative of the location of the leading edge of the document 11. Concurrently, sensor 52 generates a logic signal, as shown in FIG. 8*c*, which will be low if the carrier is in position to properly receive the document with guide track 33 in its normal position, but which will be high if the carrier is not in such position. The document signal 8*b* and carrier signal 8*c* are applied to the input terminals of an And gate 76. If the document signal 8*b* occurs while a logic low signal is present at And gate 76 from sensor 52, indicating that carrier 38 will be a document accept position 60 at the time the document arrives at the carrier 38, there will be no output pulse from And gate 76 and circuit 70 will generate no additional signal and the guide track 33 will remain in the first or normal position. When logic high signals are simultaneously present at the inputs of And gate 76, a pulse as shown in FIG. 8*d* is formed at the output of And gate 76, the pulse is delayed by adjustable time delay 78 and is applied to the input of a solenoid drive circuit 80 that energizes solenoid 39 after a predetermined delay time as shown in FIG. 8*e*. Energization of solenoid 39 causes the rotation of shaft 37 which in turn moves support 36 and guide track 33 to a second or deflecting position. The duration of time solenoid 39 remains energized is adjustable as by a variable resistor R. The energization delay time and the extended period of energization are required to insure proper handling of both the document preceding the most recently sensed document and the presently sensed document. The spacing between documents assures that the guide track 33 will have sufficient time to return to its first position before the next document must be directed to carrier 38.

During operation of the microfilming apparatus 10, a stack of documents 11 such as checks to be processed are placed in receiving tray 14 and drive roller 22 is actuated and placed in contact with the top-most check in the stack and advances it into the nip of the rollers 24 and 26. Rollers 24, 26, because of the direction of rotation, advance checks seriatim to station 16. Within station 16, the check is endorsed and/or cancelled and microfilmed. After it is microfilmed, the check is advanced into the nip of drive rollers 28 and 30, which advance it into belt transport section 32. As the check is accelerated through belt transport section 32, it passes sensor 53 which generates a signal representative of the check's position. Meanwhile, sensor 52 generates a signal representative of the position of the non-accept portions 62 of the carrier 38. Circuit 70 compares the two signals and, when necessary, energizes solenoid 39 to move guide track 33 from its first or normal position to its deflecting position. Guide track 33 in either its first or second position directs the check to an accept portion 60 of the carrier 38 for insertion into a receiving slot 37. The rotation of carrier 38 delivers the check to stripping station 44 where the check is removed from the carrier by stripping member 46 and deposited on stacking platform 48. Because platform 48 is skewed, checks deposited thereon from a stack having two adjacent edges of each of the documents in register with the adjacent edges of the other documents.

The invention has been described in detail with particular reference to a preferred embodiment thereof, but it will be understood that variations and modifications can be effected within the spirit and scope of the invention.

I claim:

1. A stacking apparatus for receiving and stacking documents fed to it in a random spaced apart relationship by delivery means, said apparatus comprising:

carrier means movable at a constant predetermined speed and forming a plurality of equally spaced document-accepting segments interspersed with document non-accepting segments;

delivery means for moving documents at a constant speed correlated with the speed of said carrier, said delivery means being movable between a first position and a second position for delivering documents to said carrier means at respective first and second discharge areas;

comparator means for sensing the orientation of the carrier means relative to a document in the delivery means and for moving said delivery means to said second position whenever the orientation of said delivery means would result in said document encountering a document non-accepting segment of the carrier means and would not allow said document to enter a document-accepting segment when said delivery means is in said first position; and means for removing an inserted document from an accepting segment of said carrier and depositing the removed document in a stacked relationship with preceding documents.

2. A stacking apparatus for receiving and stacking documents fed to it in a random spaced apart relationship by a delivery mechanism, said apparatus comprising:

a rotatable carrier having uniformly-spaced, peripherally-disposed document receiving slots separated by arcuate fingers;

means for rotating said carrier at a generally constant predetermined speed;

a delivery mechanism for feeding a document edgewise toward said carrier at a rate correlated with the movement of said carrier;

guide means having a discharge end for discharging documents from the delivery mechanism toward the periphery of said carrier;

said discharge end being movable in a generally peripheral direction to said carrier between a first and a second position spaced at least an amount equal to the spacing between adjacent document receiving slots;

means for sensing the presence of a document at a predetermined position in the delivery mechanism and producing a signal in response thereto;

means for sensing the rotational orientation of said carrier;

comparator means responsive to said first and second signals for generating an output whenever the relative timing of said signals indicates that a document following said guide means when in the first position will be precluded from entering a receiving slot as a result of a collision with a finger of said carrier;

moving means responsive to said output from said comparator means for moving said guide means to said second position; and means for removing an inserted document from said slots in said carrier and depositing the removed documents in a stacked relationship with preceding documents.

3. A stacking apparatus for receiving and stacking documents fed to it in a random spaced apart relationship by a delivery mechanism, said apparatus comprising:

a rotating carrier including a plurality of arcuate fingers defining a plurality of spiral shaped slots for receiving documents;

means for removing inserted documents from said slots in said carrier and depositing the removed documents in a stacked relationship;

guide means for directing a document as it emerges from said delivery mechanism to an area of said carrier for insertion into a receiving slot, said guide means being movable between a first position associated with a first area of said carrier and a second position associated with a second area of said carrier;

energizable means operatively associated with said guide means for moving said guide means to said second position;

means associated with said delivery mechanism for sensing and generating a signal representative of the position of a document in said delivery mechanism;

means associated with said delivery mechanism for sensing and generating a signal representative of the orientation of said fingers of said carrier; and circuit means responsive to said signals for energizing said energizable means so as to direct the document to a second area of the carrier whenever the relative timing of said signals indicates that a document following said guide means when in the first position will be precluded from entering a receiving slot as a result of a collision with a finger of said carrier.

4. A synchronous stacking device for use with a delivery mechanism that delivers documents in an individualized, spaced apart relationship for stacking, said device comprising:

a rotating carrier including a plurality of arcuate fingers defining a plurality of spiral shaped receiving slots formed between said fingers for accepting individual documents in said slots;

means operative associated with said carrier for removing documents from the slots in said carrier and for guiding the sheets into superimposed stacked relationship;

guide means movable between a first and a second position for directing a document from the delivery mechanism to one of two areas for insertion into one of said slots in said carrier;

means for sensing and generating a signal representative of the position of a document in said delivery mechanism;

means for sensing and generating a signal representative of the orientation of said fingers;

circuit means responsive to said signals for generating a control signal whenever the relative timing of said signals indicates that a document following said guide means when in said first position will be precluded from entering a receiving slot as a result of a collision with a finger of said carrier;

means responsive to said control signal for moving said guide means to said second position which is appropriate for acceptance of said document; and return means for moving said guide means from said second position to said first position a predetermined time after said control signal.

5. A stacking device as claimed in claim 4 wherein said circuit means further comprises means for delaying the generating of said control signal.

6. In a synchronous stacking device for use with a delivery mechanism that delivers documents of random size in an individualized spaced apart relationship for stacking, said device comprising a rotating carrier having a plurality of parallel discs mounted on a common shaft, each of said discs including a plurality of arcuate fingers defining a plurality of spiral shaped receiving slots formed between said fingers for accepting individual documents, the slots of each disc being aligned with the slots of each other disc; a stripping station positioned between said discs of said carrier for removing documents from the slots of the carrier and guiding the documents to form a stack in superimposed relationship; and means for directing documents from the delivery mechanism to the carrier, the improvement wherein said means for directing comprises;

means for sensing and generating a signal representative of the position of a document in the delivery mechanism;

means for sensing and generating a signal representative of the orientation of said fingers of said carrier separating adjacent receiving slots;

guide means for directing a document from the delivery mechanism to a segment of the carrier for insertion into a receiving slot, said means being movable between a first position associated with a first segment of the carrier and a second position associated with a second segment of the carrier;

circuit means responsive to said signals for generating a control signal whenever the relative timing of said signals indicates that a document following the guide track in said first position will be precluded from entering a receiving slot in the first segment; and means responsive to said control signal for moving said guide means to said second position thereby assuring insertion in a receiving slot in said second segment.

* * * * *